US007726797B2

(12) United States Patent
Jones et al.

(10) Patent No.: US 7,726,797 B2
(45) Date of Patent: Jun. 1, 2010

(54) INTERMEDIATE SIDE SLOT VERTICAL INK CONSTRAINT WITH OFFSET SUPPORT

(75) Inventors: Brent Rodney Jones, Sherwood, OR (US); Brian Walter Aznoe, Sherwood, OR (US); Darrell Ray Finneman, Albany, OR (US)

(73) Assignee: Xerox Corporation, Norwak, CT (US)

( * ) Notice: Subject to any disclaimer, the term of this patent is extended or adjusted under 35 U.S.C. 154(b) by 782 days.

(21) Appl. No.: 11/605,015

(22) Filed: Nov. 28, 2006

(65) Prior Publication Data

US 2008/0122908 A1 May 29, 2008

(51) Int. Cl.
*B41J 2/17* (2006.01)
*B41J 2/01* (2006.01)

(52) U.S. Cl. ..... 347/88; 347/99; 347/103

(58) Field of Classification Search ..... 347/88, 347/99, 103

See application file for complete search history.

(56) References Cited

U.S. PATENT DOCUMENTS 5,223,860 A 6/1993 Loofbourow et al.
5,442,387 A 8/1995 Loofbourow et al.
5,510,821 A 4/1996 Jones et al.
5,734,402 A 3/1998 Rousseau et al.
5,861,903 A 1/1999 Crawford et al.
6,056,394 A 5/2000 Rousseau et al.
6,530,655 B2 3/2003 Jones et al.
6,543,867 B1 4/2003 Jones
6,572,225 B1 6/2003 Jones
6,679,591 B2 1/2004 Jones
6,705,710 B2 3/2004 Jones et al.
6,709,094 B2 3/2004 Jones
6,719,413 B2 4/2004 Jones
6,719,419 B2 4/2004 Jones et al.
6,722,764 B2 4/2004 Jones et al.
6,739,713 B2 5/2004 Jones et al.
6,755,517 B2 6/2004 Jones et al.
6,761,443 B2 7/2004 Jones
6,761,444 B2 7/2004 Jones et al.
6,840,612 B2 1/2005 Jones et al.
6,840,613 B2 1/2005 Jones
6,893,121 B2 5/2005 Jones
6,966,644 B2 11/2005 Jones et al.
6,986,570 B2 1/2006 Jones et al.
7,066,589 B2 6/2006 Jones et al.
7,104,635 B2 9/2006 Jones
7,108,363 B2 9/2006 Jones et al.
2003/0202064 A1* 10/2003 Jones et al. ..... 347/88
2003/0202067 A1* 10/2003 Jones et al. ..... 347/88
2003/0202074 A1* 10/2003 Jones ..... 347/99

* cited by examiner

*Primary Examiner*—Manish S Shah
(74) *Attorney, Agent, or Firm*—Maginot, Moore & Beck LLP

(57) ABSTRACT

An ink stick cooperates with structure in a feed channel of a phase change ink printer to reduce steering effects from pushing the ink sticks along the longitudinal axis of the feed channel. The ink stick includes an ink stick body having a top surface, a bottom surface, a lateral dimension between two partial sides of the ink stick, and a lateral center of gravity within the lateral dimension, a support in a bottom surface of the ink stick body, the support being located at a position that is laterally offset from the lateral center of gravity within the lateral dimension, and a skew limiter in a side of the ink stick body that is opposite the lateral offset position of the support, the skew limiter being in the side of the ink stick body intermediate the bottom surface and the top surface of the ink stick body.

20 Claims, 12 Drawing Sheets

INTERMEDIATE SIDE SLOT VERTICAL INK CONSTRAINT WITH OFFSET SUPPORT

CROSS-REFERENCE TO RELATED APPLICATIONS

Reference is made to commonly-assigned co-pending U.S. patent application Ser. No. 11/605,100, filed concurrently herewith, entitled "LATERAL ANTI-SKEWING SOLUTION FOR SOLID INK", by Brent R. Jones et al., the disclosure of which is incorporated herein by reference.

TECHNICAL FIELD

This disclosure relates generally to ink printers, the ink sticks used in such ink printers, and the devices and methods used to provide ink to such printers.

BACKGROUND

Solid ink or phase change ink printers conventionally receive ink in a solid form, either as pellets or as ink sticks. The solid ink pellets or ink sticks are typically placed in an "ink loader" having a feed chute or channel. A feed mechanism delivers the solid ink sticks through the feed channel to a heater assembly. In some solid ink printers, gravity pulls solid ink sticks through the feed channel to the heater assembly. Typically, a heater plate ("melt plate") in the heater assembly melts the solid ink impinging on it into a liquid that is delivered to a print head for jetting onto a recording medium. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al., the disclosures of which are incorporated herein by reference, describe exemplary systems for using solid ink sticks ("phase change ink sticks") in a phase change ink printer.

FIG. 1 is a simplified cross-sectional view of a prior art feed channel 20 and one of a plurality of phase change ink sticks 24. The previously known phase change ink sticks 24 have included various top surfaces 28, bottom surfaces 32, side surfaces 36, and side surfaces 40. These surfaces may be complementary or otherwise correspond to ink loader features to support and guide the ink sticks into optimal feed/melt positions. Some horizontal or near horizontal ink loaders have included "lower laterally offset" or "bottom laterally offset" ink stick supports and/or guide rails 44 that are vertically below and laterally offset from the ink stick centers of gravity 47. In addition to substantially supporting the weights of the ink sticks 24, these ink loader structures 44 have also slidably engaged corresponding protruding and/or inset ink stick features 52 to guide the ink sticks 24 to melt plates (not shown) along substantially straight or other prescribed feed paths. As may be understood by viewing the structure shown in FIG. 1, gravity causes the side 40 of the ink stick 24 which is opposite the lower laterally offset feature 44 to lean and slide against the feed channel wall 48.

Ink loaders typically hold many ink sticks at once and each individual ink stick typically must travel several times its length to reach the melt plate. The wax-like components from which phase change ink sticks are typically made are typically designed to bond to media of many different types, and, accordingly, they may become slightly sticky in some environmental conditions. Consequently, some phase change ink printers occasionally encounter intermittent sticking and slipping of ink sticks in the ink loaders as the ink sticks are pushed through the ink loaders. Ink loader length and complexity of the feed path may also contribute to the intermittent sticking of ink sticks in the feed channel.

FIG. 2 is a simplified cross-sectional view of a prior art feed channel 60 and a phase change ink stick 24. In channel 60, an additional support 64 protrudes from the lateral side that is opposite the lower offset features 68. The support 64 helps reduce the opportunity for intermittent sticking by enabling gravity to cause the ink stick 24 to pivot somewhat (e.g., as indicated generally by the arrow 72) about the lower laterally offset features 68 and slidably lean against the side rail feature 64. While side rail features, such as support 64, have worked reasonably well to properly position and orient ink sticks 24 in their path to a melt plate, sometimes reverse pivoting or other dislodging of the ink sticks 24 occurs when a printer is moved or jostled during normal use. These actions may result in misalignments of the ink sticks 24 that can lead to misalignment of the ink sticks in the feed channel and impact their progress down the feed channel. Leaning may also result in side loads in the lower guides that may amplify sticking issues arising from friction between the phase change ink sticks and the guides.

As emerging technologies reduce the time for generating solid ink images, faster solid ink delivery systems must be developed. Increased speed, however, may increase the risk of intermittent sticking. One proposed solution is to widen the phase change ink sticks to increase melt surface areas to generate more ink as an ink stick is melted. Increasing the size of the ink sticks may result in greater size tolerances for manufacturing the ink sticks and for construction of the corresponding ink loaders. These increased tolerances may lead to larger clearances between the ink sticks and corresponding ink loader guide features. These enlarged clearances could allow undesirable skewing and jamming of the ink sticks in some ink loaders, especially with ink sticks widened so their width-to-length ratios ("aspect ratios") drop much below 1:1. Therefore, enhanced control of ink sticks as they move through a feed channel is desirable.

SUMMARY

An ink stick cooperates with structure in a feed channel of a phase change ink printer to reduce steering effects from pushing the ink sticks along the longitudinal axis of the feed channel. The ink stick includes an ink stick body having a bottom surface, a top surface, a lateral dimension between two sides of the ink stick, and a lateral center of gravity within the lateral dimension, a support elevationally offset from a bottom surface of the ink stick body, the support being located at a position that is laterally offset from the lateral center of gravity within the lateral dimension, and a skew limiter in a side of the ink stick body that is opposite the lateral offset position of the support, the skew limiter being in the side of the ink stick body intermediate the bottom surface and the top surface of the ink stick body.

The ink loader for a phase change ink printer includes structure for cooperating with the ink stick to reduce steering in the longitudinal direction of the feed channel. The ink loader includes an insertion key plate for excluding ink sticks without complementary features conforming to a keyed opening in the insertion key plate, a plurality of feed channels having a top and a bottom, each feed channel receiving ink sticks through a keyed opening in the insertion key plate, a support mounted parallel to and laterally offset from a central longitudinal axis of the feed channel, and a longitudinal feed channel rail located between the top and the bottom of a channel to support an ink stick on a side opposite the support.

A method for delivering solid ink sticks to a melt plate through a feed channel includes receiving ink sticks through keyed openings in an insertion plate, pushing the ink sticks along a longitudinal axis of a feed channel, engaging a bottom portion of the ink stick with a support at a position that is laterally offset from a lateral center of gravity for the ink sticks, and limiting skewing of the ink stick with a guide rail in the channel to reduce steering effects from pushing the ink sticks along the longitudinal axis of the feed channel.

DETAILED DESCRIPTION OF THE PREFERRED EMBODIMENT

Figure 1:
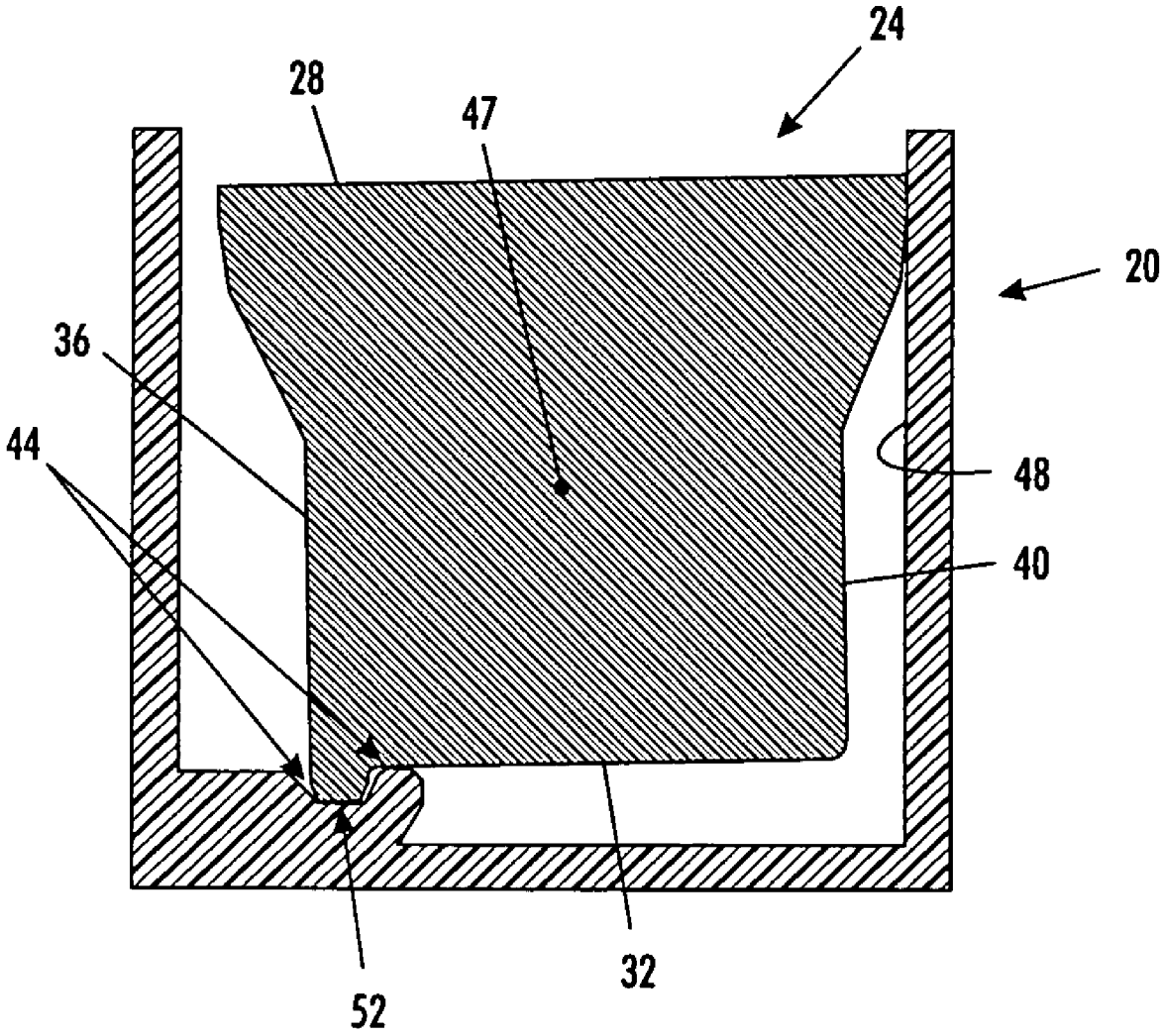
FIG. 1 PRIOR ART
FIG. 1 is a simplified cross-sectional view of a prior art feed channel and a phase change ink stick within the feed channel.
Figure 2:
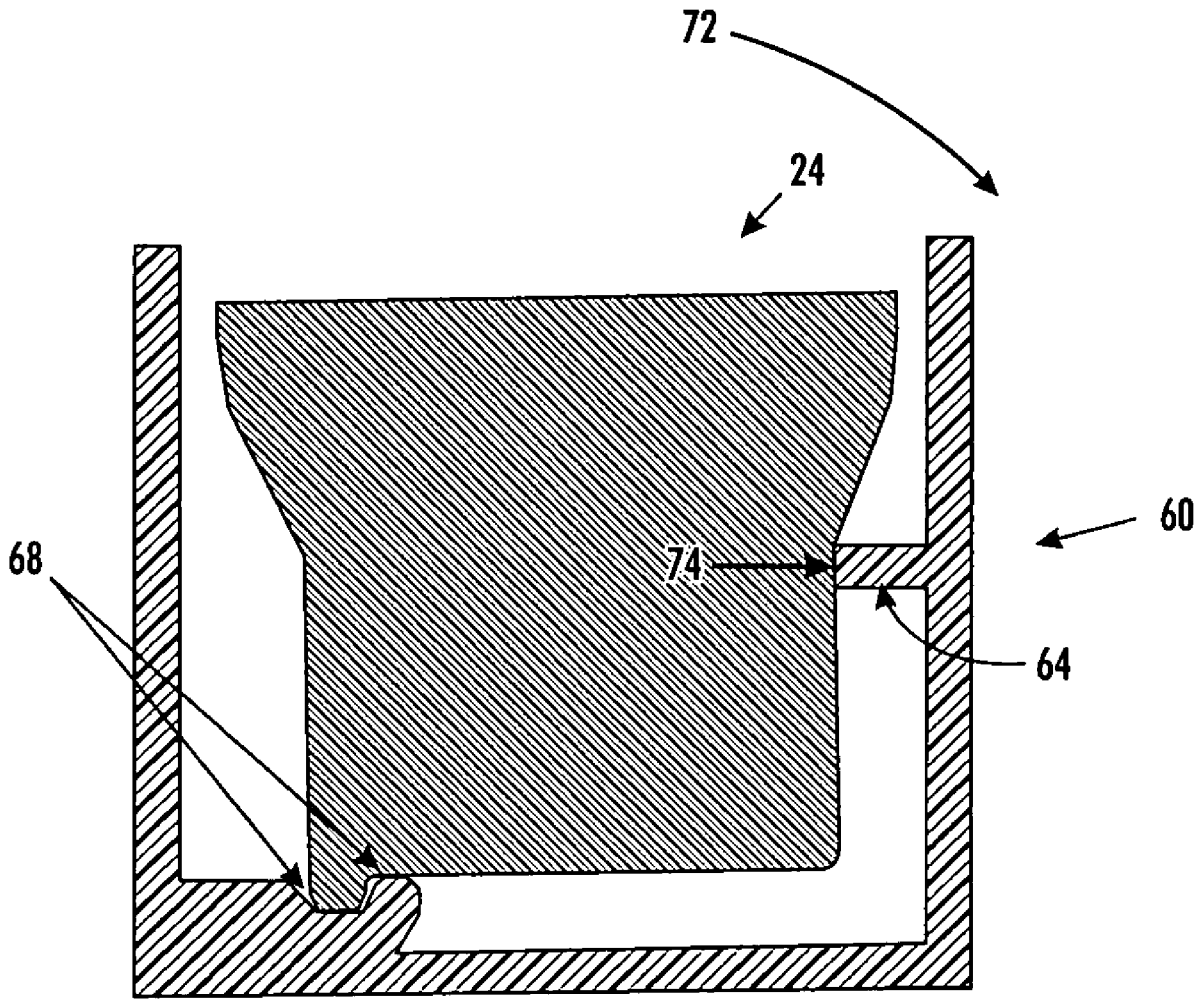
FIG. 2 PRIOR ART
FIG. 2 is a simplified cross-sectional view of another prior art feed channel and the phase change ink stick of FIG. 1.

Like reference numerals refer to like parts throughout the following description and the accompanying drawings.

Figure 3:
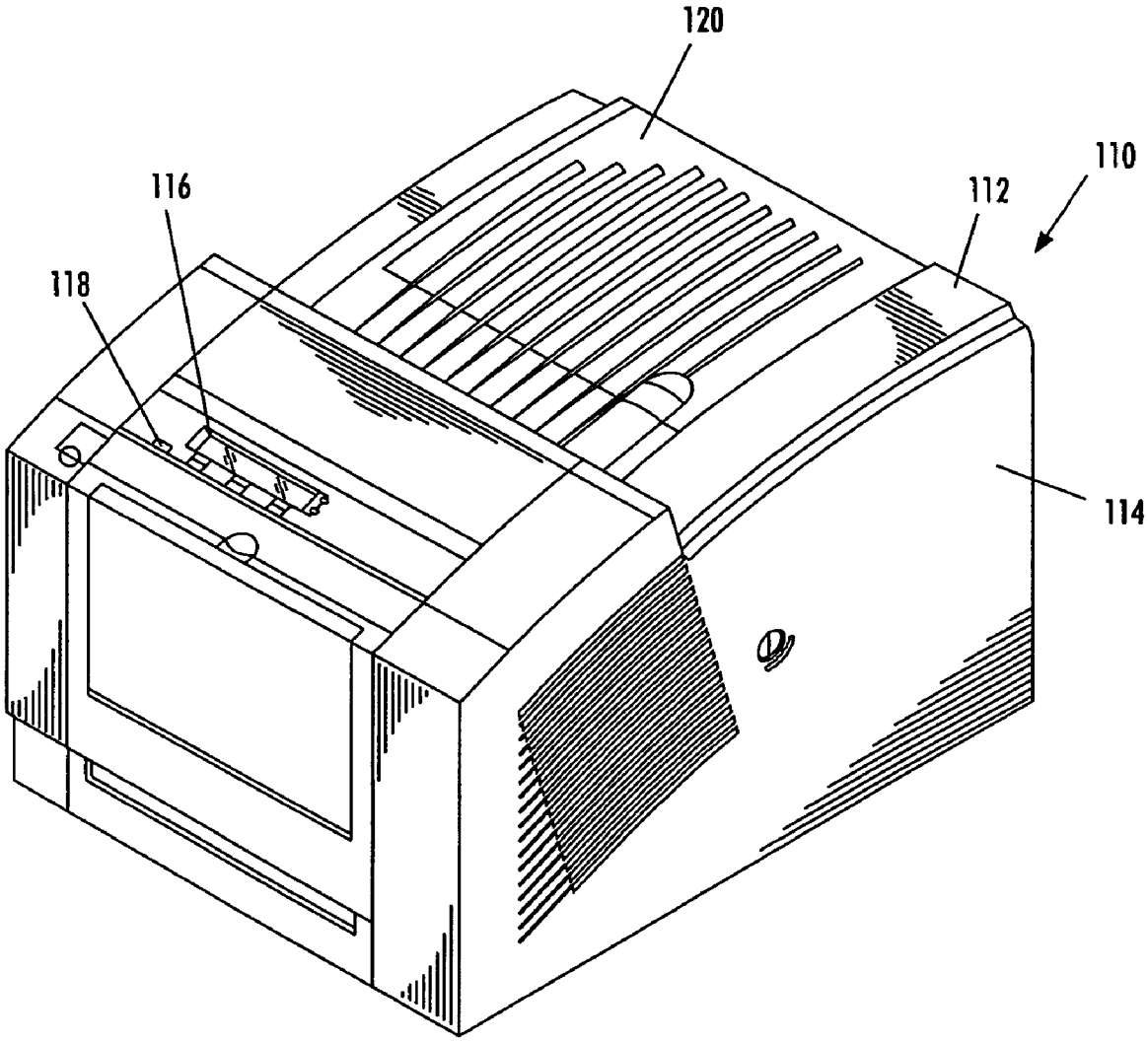
FIG. 3 is a perspective view of an exemplary phase change ink printer.

FIG. 3 is a perspective view of an exemplary phase change ink printer 110. Printer 110 includes an outer housing having a top surface 112 and side surfaces 114. A user interface display, such as a front panel display screen 116, displays information concerning the status of the printer, and user instructions. Buttons 118 or other control actuators for controlling operation of the printer are adjacent the user interface window, or may be at other locations on the printer. An ink jet printing mechanism (not shown) is contained inside the housing. Such a printing mechanism is described in U.S. Pat. No. 5,805,191, entitled Surface Application System, to Jones et al, and U.S. Pat. No. 5,455,604, entitled Ink Jet Printer Architecture and Method, to Adams et al, the disclosures of which are incorporated herein by reference. The top surface of the housing includes a hinged ink access cover 120 that opens (see FIG. 4) to provide the user access to an ink feed system (see FIG. 5) contained under the top surface of the printer housing that delivers ink to the printing mechanism.

Figure 4:
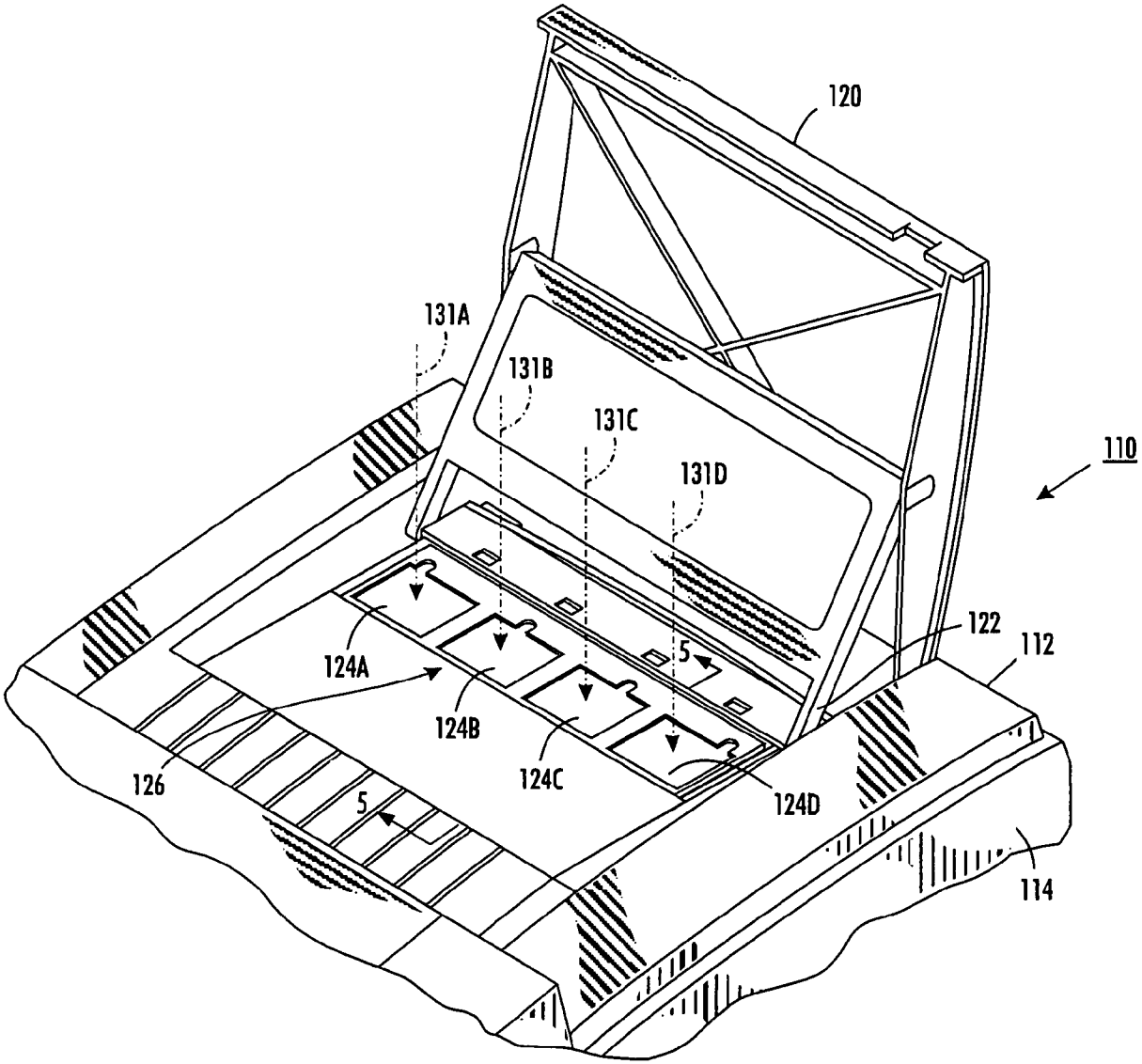
FIG. 4 is a partial top perspective view of the phase change ink printer of FIG. 3 with its ink access cover open.

FIG. 4 is a partial top perspective view of the phase change ink printer 110 with its ink access cover 120 open. As at least partially discernable in FIG. 4, the ink access cover 120 is attached to an ink load link 122 so that when the ink access cover 120 is raised, the ink load link 122 slides and pivots to an ink load position. The interaction of the ink access cover 120 and the ink load link 122 is described in U.S. Pat. No. 5,861,903 for an Ink Feed System, issued Jan. 19, 1999 to Crawford et al., the disclosure of which is incorporated herein by reference, though with some differences noted below. Opening the ink access cover 120 reveals an insertion key plate 126 having keyed openings 124A-D. Each keyed opening 124A, 124B, 124C, 124D provides access to a feed key plate 327 having respective keyed openings 328A, 328B, 328C, 328D (see FIG. 5 and FIG. 7) positioned at the insertion end(s) of respective individual feed channels 129A, 129B, 129C, 129D (see, e.g., FIG. 5) of the solid ink feed system. In the exemplary embodiment, the feed key plate 327 (see FIG. 5 and FIG. 7) is oriented generally perpendicularly to the insertion key plate 126. As discussed further below (see FIG. 5 and FIG. 7), the phase change ink printer 110 is configured to receive ink sticks 330A, 330B, 330C, and 330D inserted through the respective keyed openings 124A, 124B, 124C, 124D (as indicated generally by respective insertion direction arrows 131A, 131B, 131C, and 131D) and to advance or feed the ink sticks 330A-D through the respective keyed openings 328A, 328B, 328C, 328D and further through the respective feed channels 129A, 129B, 129C, 129D.

Figure 5:
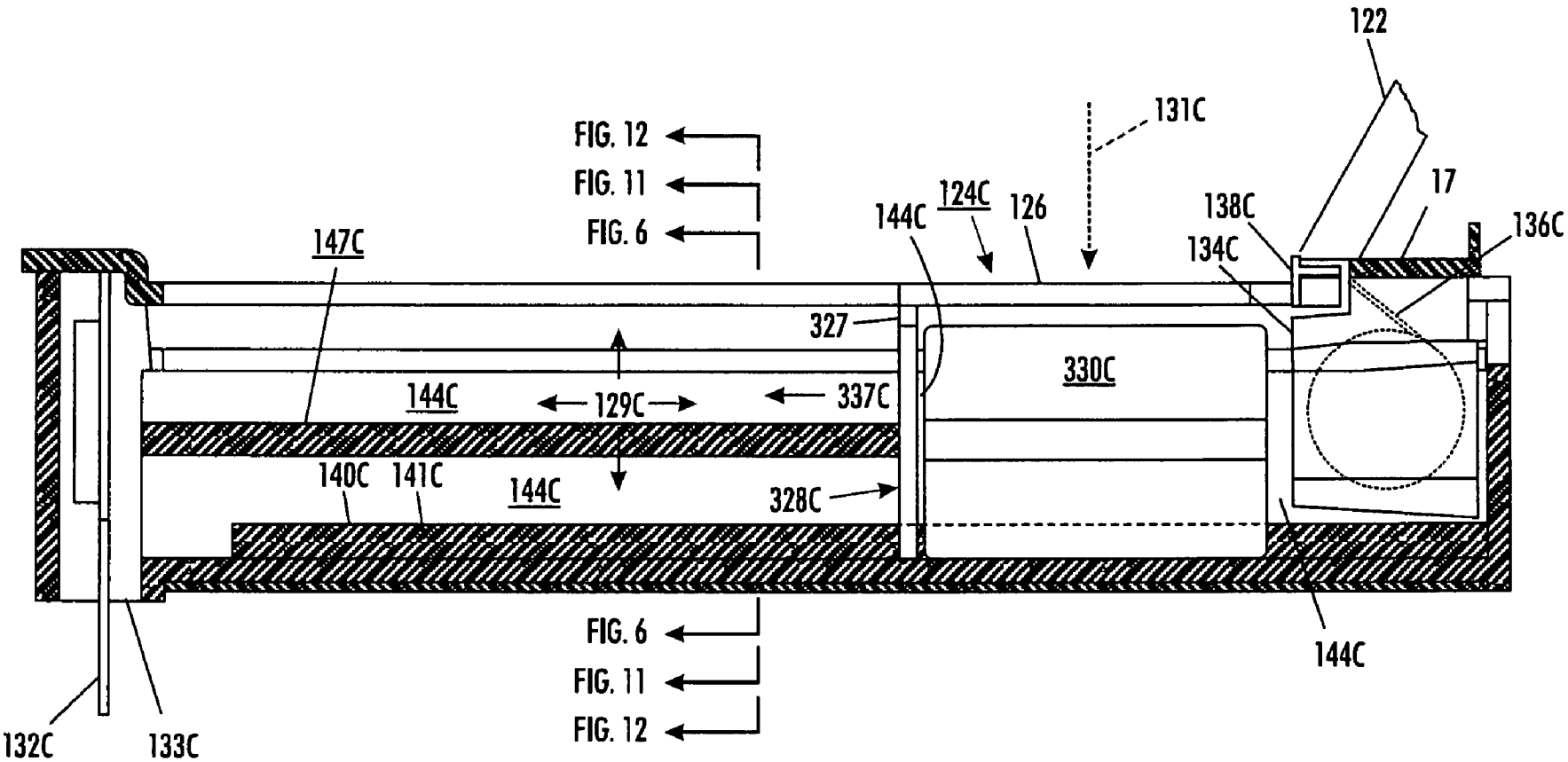
FIG. 5 is a side sectional view of a feed channel of the solid ink feed system of the phase change ink printer of FIG. 3 (and FIG. 4) taken along line 5-5 of FIG. 4.

FIG. 5 is a side sectional view of feed channel 129C of the solid ink feed system of the phase change ink printer 110 taken along line 5-5 of FIG. 4. Each longitudinal feed channel 129A-D is configured to receive respective ink sticks 330A-D of respective colors. For example, ink stick 330A is yellow, ink stick 330B is cyan, ink stick 330C is magenta, and ink stick 330D is black, (FIG. 8). The ink sticks are inserted through the respective keyed openings 124A-D (see also FIG. 4) of the insertion key plate 126. The ink sticks 330A-D are then advanced through the respective keyed openings 328A-D (see also FIG. 7) of the feed key plate 327 to the respective melt plates 132A-D. For clarity of exposition, FIG. 5 focuses on feed channel 129C and in FIG. 5 ink stick 330C is illustrated without key features. In the exemplary embodiment, feed channels 129A, 129B, and 129C are likewise configured and they extend, respectively, from keyed openings 124A, 124B, and 124D.

With continued reference to FIG. 5, feed channel 129C has a longitudinal feed direction, indicated generally by direction arrow 337C, from its insertion end 124C to its melt end adjacent to the melt plate 132C. The melt plate 132C melts the solid ink stick 330C into a liquid form. The melted ink drips through a gap 133C between the melt end of the feed channel 129C and the melt plate 132C, and into a liquid ink reservoir (not shown). Feed channel 129C has a longitudinal dimension extending from the insertion end to the melt end, and a lateral dimension substantially perpendicular to the longitudinal dimension. Feed channel 129C includes a push block 134C driven by a driving force, such as a constant force spring 136C, to push ink stick 330C and/or a succession of ink sticks 330C along the length of feed channel 129C toward the melt plate 132C that are at the melt end of each feed channel. The tension of the constant force spring 136C drives the push block 134C toward the melt end of the feed channel 129C. As described in U.S. Pat. No. 5,861,903, the disclosure of which is incorporated herein by reference, the ink load linkage 122 (see also FIG. 4) is coupled to a yoke 138C, which is attached to the constant force spring 136C mounted in the push block 134C. The attachment to the ink load linkage 122 pulls the push block 134C toward the insertion end of the feed channel 129C when the ink access cover 120 (see FIG. 4) is raised to reveal the insertion key plate 126.

Figure 6:
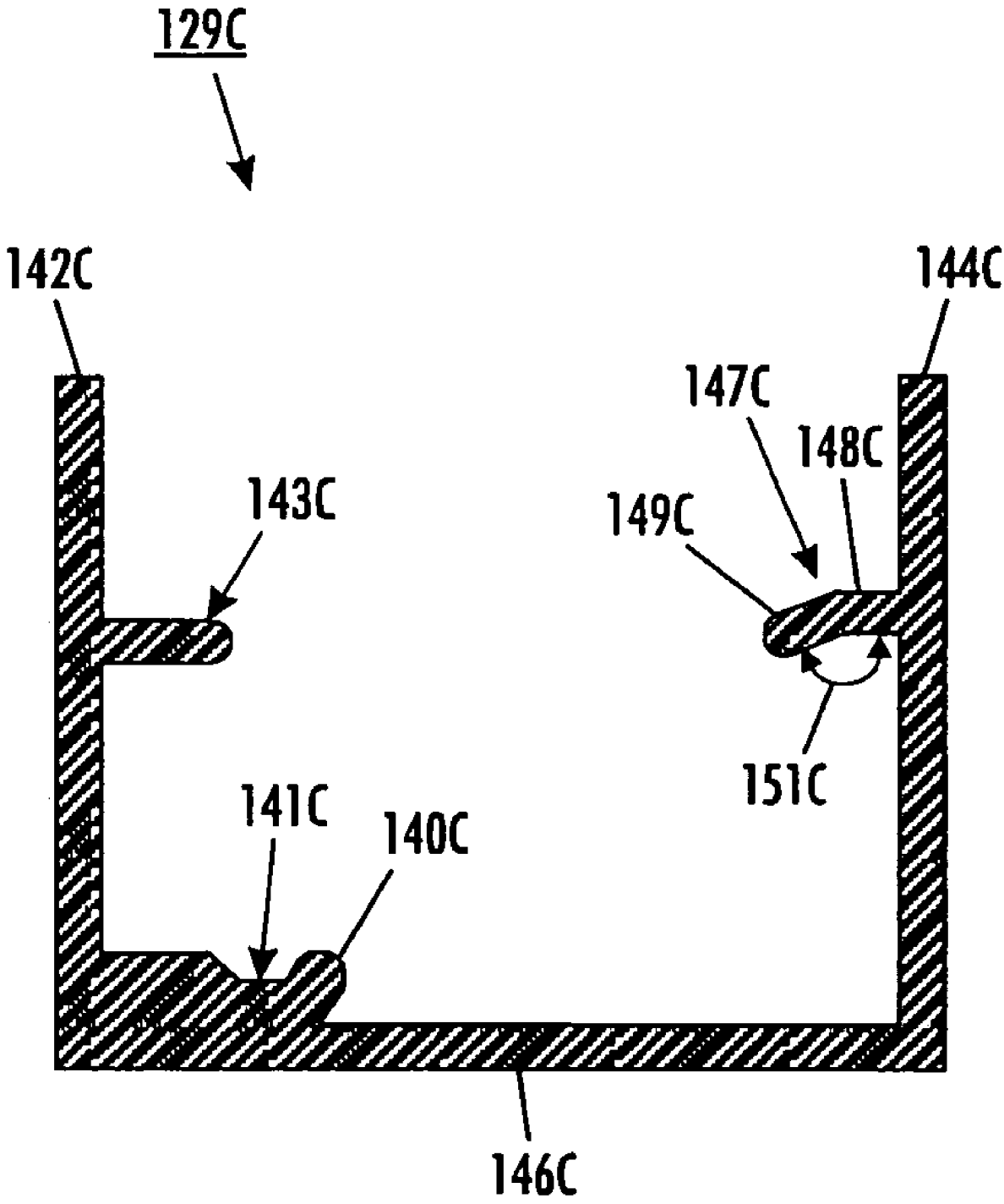
FIG. 6 is a simplified cross-sectional view of the feed channel of FIG. 5 taken along line 6-6 of FIG. 5.

A lower portion of the feed channel 129C includes a longitudinal feed channel support/guide rail 140C and defines an accompanying longitudinal feed channel support/guide trough or groove 141C adjacent and parallel to the feed channel support/guide rail 140C (see also FIG. 6). The feed channel support/guide rail 140C and the feed channel support/guide groove 141C are laterally offset from the central longitudinal axis of the feed channel 129C (see FIG. 6), and are designed to support and guide a bottom surface of the ink stick 330C as discussed further below. Additionally, the feed channel 129C includes a longitudinal feed channel side support/guide rail 147C extending laterally inwardly from about the vertical midpoint of the lateral side wall 144C (see also FIG. 6). The feed channel side support/guide rail 147C extends from a position near the melt end of the feed channel 129C to, but not into, the key plate 327 insertion area. This arrangement enables an ink stick to be inserted without the guide rail 147C interfering with the downward insertion of the ink stick. As used herein, the term "support" refers to a surface or structure that bears all or a portion of the weight of an object and the term "guide" refers to a surface or structure that assists in maintaining alignment or orientation of an object. In a horizontal orientation, the full mass of an ink stick bears on supports as gravity pulls the ink to these supports. As the loader orientation becomes more vertical, force from ink stick mass is directed more to the stack of ink sticks and the melt plate into which they progress than the support surfaces. In this case, the support may become guidance or constraining surfaces.

FIG. 6 is a simplified cross-sectional view of the feed channel 129C taken along line 6-6 of FIG. 5. For clarity of exposition FIG. 6 focuses on feed channel 129C. In the exemplary embodiment, feed channels 129A, 129B, and 129D are likewise configured. As at least partially discernable in FIG. 6, the feed channel 129C is defined by lateral side walls 142C, 144C that are substantially vertical, and a bottom 146C, which may be recessed, open, or partially open. The transverse dimension of the feed channel 129C is between its lateral side walls 142C, 144C. The longitudinal feed channel support/guide rail 140C and the adjacent longitudinal feed channel support/guide groove 141C are included in a lower portion of the feed channel 129C, preferably near the bottom 146C. As noted above, the feed channel support/guide rail 140C and the feed channel support/guide groove 141C are parallel and laterally offset from the central longitudinal axis of the feed channel 129C, and they are designed to receive a bottom surface of the ink stick 330C as discussed further below. As noted above, the feed channel 129C includes the longitudinal feed channel side support/guide rail 147C, which extends inwardly from an elevated position relative to the lower support and about the vertical midpoint of the lateral side wall 144C. The feed channel side support/guide rail 147C may be non-flat or contoured so that it incorporates an ink contactor area 148C and a constraining extension 149C. The contactor 148C extends laterally inward from and generally perpendicularly at a position, in the example configuration, near the vertical midpoint of the lateral side wall 142C. The extension 149C extends generally inward from the contactor 148C at an angle 151C relative to the contactor 148C. The angle 151C may be less than 180 degrees, such as about 150 degrees, although other angles may be used. Alternatively, the contour may be a continuous or variable radius. The contactor is intended to provide a predictable line of contact that the ink stick uses for support on that side of the channel. The extension protrudes beyond the contact to a narrower inset or waist point within an ink stick that is closer to the center of the stick so that unintended rotation of the stick is restricted. The extension limits movement, but need not contact the ink stick under normal operational conditions. The extension is configured to enable limited contact with an ink stick to an area along the contactor.

Figure 7:
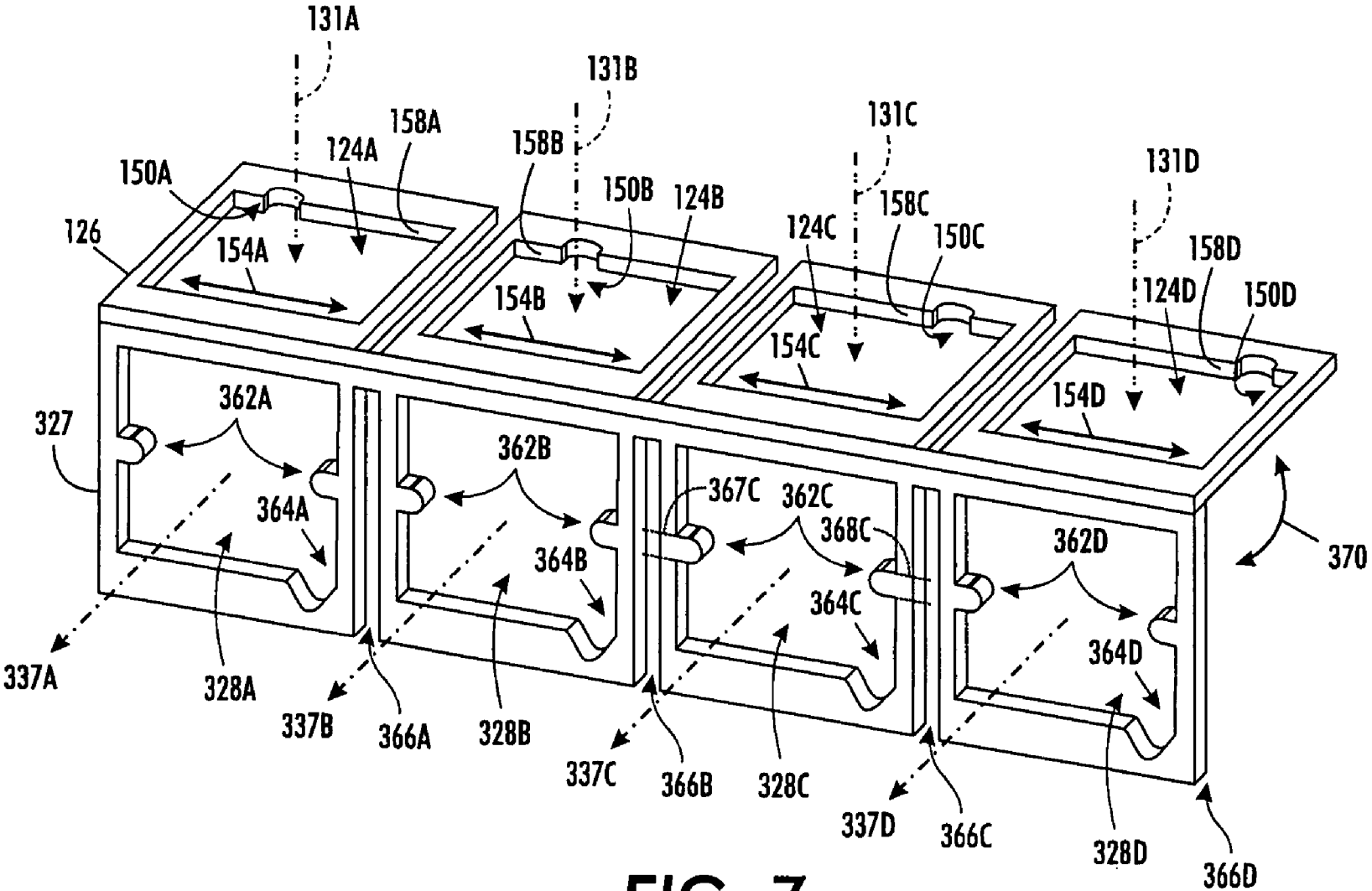
FIG. 7 is a top/front perspective view of the insertion key plate and the feed key plate of the phase change ink printer of FIG. 3 (and FIG. 4).
Figure 8:
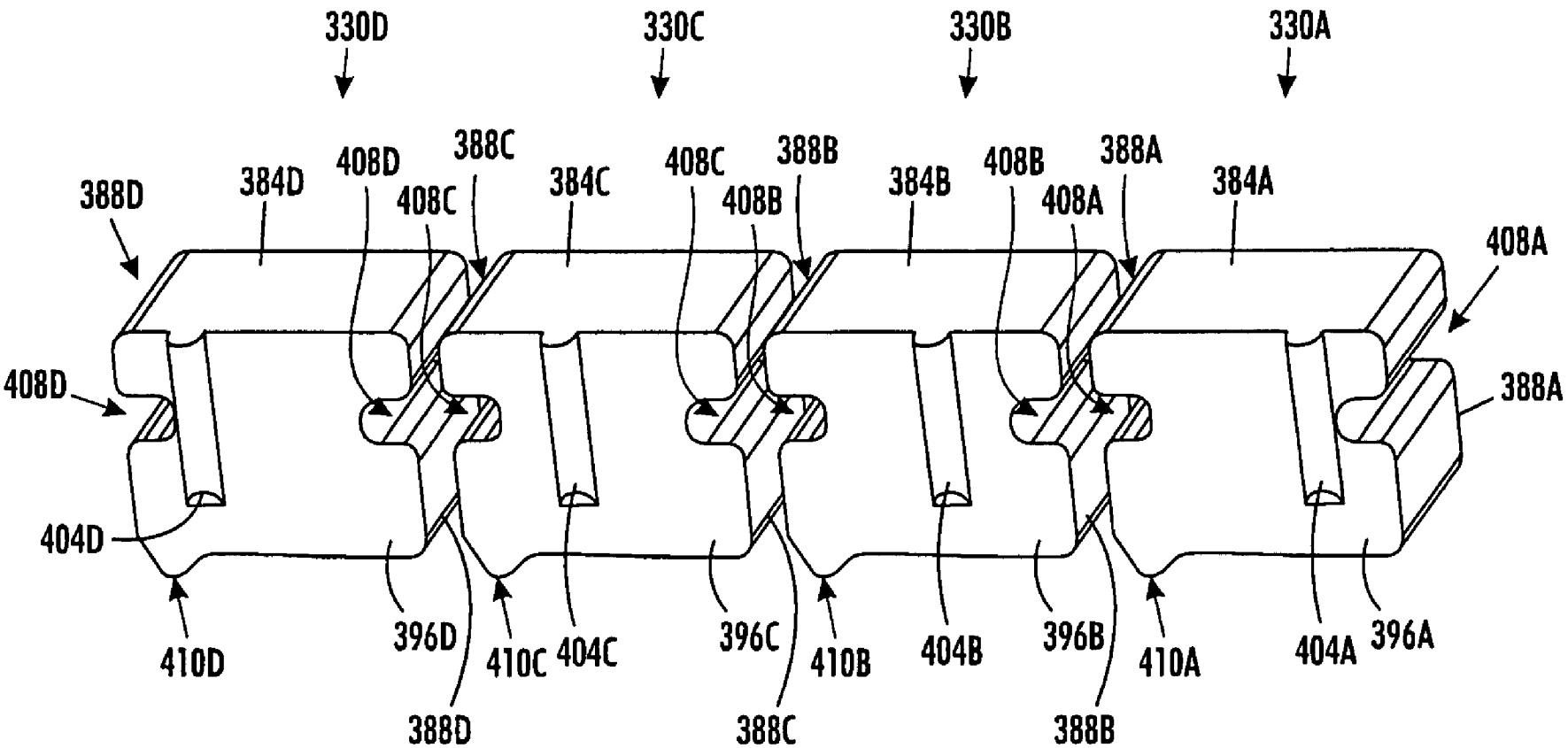
FIG. 8 is a top/back perspective view of exemplary ink sticks configured for use in the phase change ink printer of FIG. 3 (and FIG. 4, FIG. 5, FIG. 6, and FIG. 7).

FIG. 7 is a top/front perspective view of the insertion key plate 126 and a feed key plate 327. As at least partially discernable in FIG. 7, the perimeters of the keyed openings 124A-D define generally U-shaped notch-like indentation or "female key features" 150A-D. Further, keyed openings 124A-D have respective lateral dimensions or widths 154A-D and respective back perimeter segments or portions 158A-D. The widths 154A-D are all about equal to each other and the respective key features 150A-D are mutually exclusively or uniquely positioned along the respective back perimeter segments 158A-D.

As also at least partially discernable in FIG. 7, the feed key plate 327 defines keyed openings 328A-D. The keyed openings 328A-D are about the same size and shape. The perimeter of each keyed opening 328A-D defines a pair of laterally opposing protuberances or "male key features" 362A-D. Further, a bottom lateral corner of the perimeter of each keyed opening 328A-D also defines a generally V-shaped or generally U-shaped notch-like indentation or "female key feature" 364A-D. Feed keying may be provided by a feed key plate, such as the key plate 327, or by individual feed key plates in each independent color channel, or by the more traditional features formed in the channel, in which case, no plate is used. No feed keying may be employed for a channel or one or more feed keying features may be provided on any, all, or any combination of, sides, top, or bottom of a channel.

FIG. 8 is a top/back perspective view of exemplary ink sticks 330A-D configured for use with the phase change ink printer 110. In the exemplary embodiment, each of the ink sticks 330A-D is formed of a generally rectilinear ink stick body, although other volumetric shapes may be used. Each of the sticks 330A-D, as depicted, includes a bottom surface 380A-D (obscured in FIG. 8), a top surface 384A-D, a pair of lateral side surfaces 388A-D, substantially flat front surfaces 392A-D (obscured in FIG. 8, but see FIG. 9), and back surfaces 396A-D. The front surfaces 392A-D are substantially parallel to the respective back surfaces 396A-D and are substantially perpendicular to the respective lateral side surfaces 388A-D. However, ink sticks 330A-D are merely exemplary and in alternative embodiments the respective surfaces of the ink stick bodies need not be substantially flat, nor need they be substantially parallel or perpendicular to one another. Other shapes of the side and end surfaces are also possible, including curved surfaces. Nevertheless, the present descriptions should aid the reader in visualizing, even though the surfaces may have three dimensional topographies, or be angled with respect to one another. The ink sticks 330A-D may be formed by pour molding, compression molding, forging, or any other suitable technique or combination thereof.

Further, as at least partially discernable in FIG. 8, the back surfaces 396A-D include respective ridges or "male features" 404A-D extending from the respective top surfaces 384A-D to about ¾ of the way towards the respective bottom surfaces 380A-D. The male features 404A-D are shaped and positioned to complement and be received by the respective female key features 150A-D of the respective keyed openings 124A-D of the insertion key plate 126. The features 404A-D help exclude ink sticks of the wrong color from being inserted through each of the keyed openings 124B, 124C, and 124D (see FIG. 7).

As also at least partially discernable in FIG. 8, the pairs of generally lateral side surfaces 388A-D define respective pairs of laterally opposing generally U-shaped notch-like indentations or "female features" 408A-D that extend from the respective back surfaces 396A-D to the respective front surfaces 392A-D. These features operate as skew limiters as described below. The bottom surfaces 380A-D also include respective ridges or "male features" 410A-D that extend fully or partially from the respective front surfaces 392A-D to the respective back surfaces 396A-D. The female features 408A-D may interact with respective male key features 362A-D of the respective keyed openings 328A-D of the feed key plate 327 or alternative feed keying features. These features also enable the ink sticks 330A-D to be constrained by rails 143A-D and 147A-D as the ink sticks travel through the respective feed channels 129A-D. The male features 410A-D are also configured to slide in the respective feed channel support/guide grooves 141A-D as the ink sticks 330A-D travel through the respective feed channels 129A-D. These features are elevationally offset from the bottom surface and are complementary to the supports in the feed channel so the engagement of the features and the supports function as guiding supports as described below.

The ink sticks 330A-D of FIG. 8 have respective lateral centers of gravity between their respective pairs of lateral side surfaces 388A-D, and have respective vertical centers of gravity between the respective top surfaces 384A-D and the bottom surfaces 380A-D. In the exemplary embodiment, the ink sticks 330A-D have substantially uniform weight densities, and the lateral centers of gravity are, excepting asymmetrical features, approximately midway between the respective pairs of lateral side surfaces 388A-D. In alternative embodiments each of the exemplary male features 404A-D may be replaced with one or more longer ridges or other suitable protuberances that may span the entire back surfaces 396A-D, and each of the male features 410A-D may be replaced with one or more shorter ridges or other suitable protuberances that need not necessarily span the entire bottom surfaces 380A-D.

Figure 9:
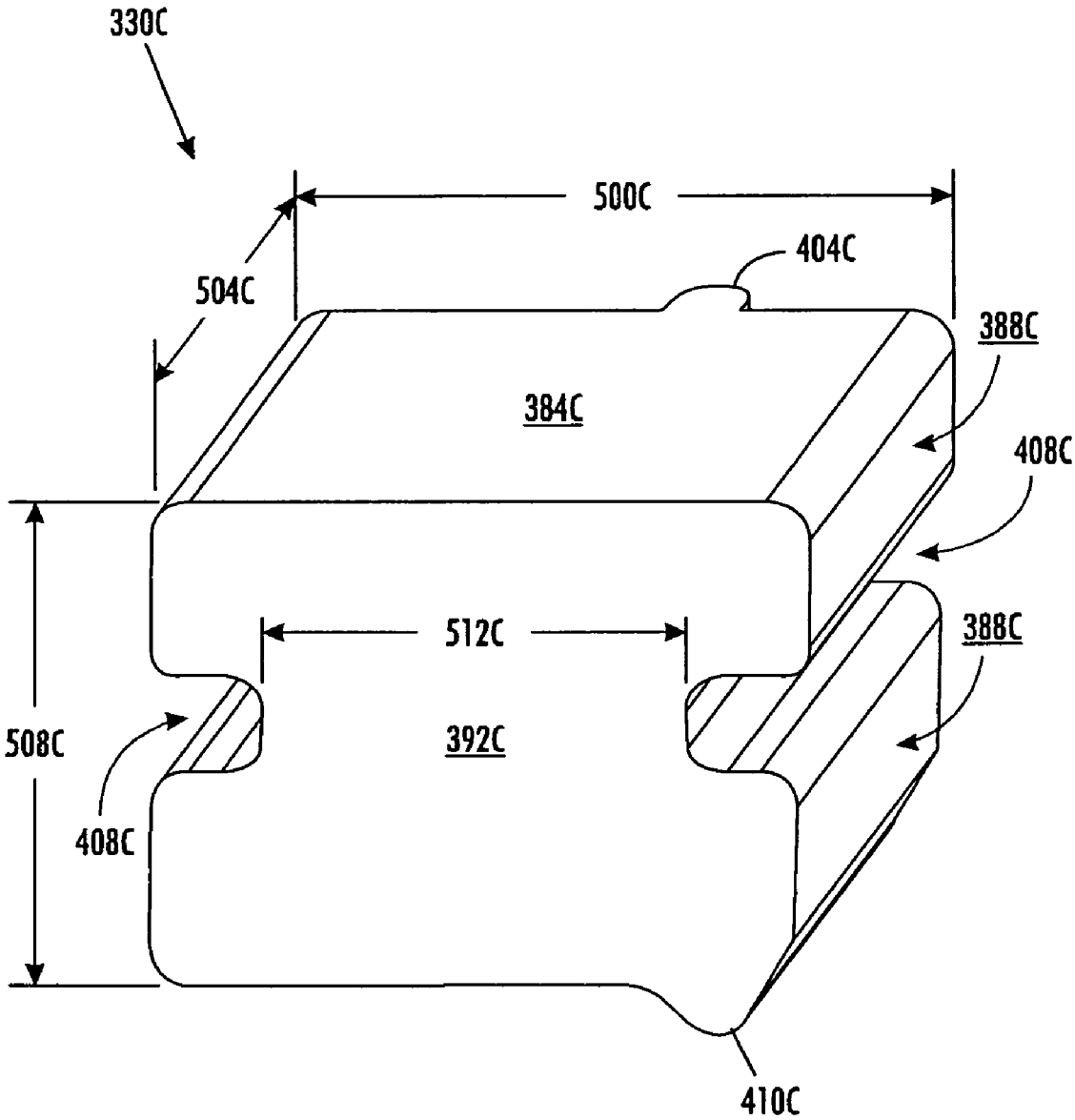
FIG. 9 is a top/front perspective view of one of the exemplary ink sticks of FIG. 8.

FIG. 9 is a top/front perspective view of the ink stick 330C. FIG. 9 focuses on the ink stick 330C for clarity of exposition, although the ink sticks 330A, 330B, and 330D are similarly configured. The respective maximum lateral dimensions or maximum widths of the ink sticks 330A-D are no wider than the lateral dimensions of the respective feed channels 129A-D between their respective side walls 142A-D and 144A-D, and in the exemplary embodiment, are only fractionally smaller than the lateral dimensions of the respective feed channels 129A-D.

As also at least partially discernable in FIG. 9, the ink sticks 330A-D have the same or nearly the same respective minimum lateral dimensions or core widths 512A-D between their respective anti-skew features 408A-D. The lengths 504A-D and the core widths 512A-D are engineered to, among other things, provide a significantly higher length-to-core width ratio ("core aspect ratio") for each of the ink sticks 330A-D over the generally central, waist or "core," portion of each ink stick than the respective length-to-maximum width ratio ("overall aspect ratio"). The favorable core aspect ratio discourages longitudinal skewing and consequent jamming of the ink sticks 330A-D in the respective feed channels 129A-D. Incorporation of the anti-skew features 408A-D enables the ink sticks 330A-D to have increased overall frontal melt areas and also increased lateral cooling surface areas. In one embodiment, one indentation may be located near the vertical center of mass between the top and the bottom of an ink stick and configured to increase peripheral surface area of the stick. These features promote more uniform temperature changes of the ink material and thus ameliorate or avoid cracking and/or deformation of the ink sticks 330A-D during manufacturing, handling, and printing operations. Although the anti-skew features 408A-D in the exemplary embodiment are positioned approximately midway between the respective bottom surfaces 380A-D (obscured in FIG. 9) and the respective top surfaces 384A-D, they may be at other positions intermediate the respective bottom surfaces 380A-D and the respective top surfaces 384A-D in alternative embodiments. These features are positioned far enough from the respective bottom surfaces 380A-D and the respective top surfaces 384A-D that these alternative embodiments of the ink sticks 330A-D are not undesirably weakened or made too fragile for normal handling. Further, the anti-skew features 408A-D in the exemplary embodiment are configured to provide a core aspect ratio of at least about 1.2:1. As an example: an ink stick with a width 2 times its length could have similar female features that extend inward about 20 to 25% of the width. Although alternative embodiments may provide lower or higher core aspect ratios, the core aspect ratio of 1.2:1 appears realistic for maintaining ink stick robustness, manufacturability, and suitable melt mass for a given frontal surface area or cross-section. Thus, one of the skew limiters may have a width that is about ten (10) to about forty (40) percent of the width of the ink stick body. Depending on ink stick size and mass, dimensional influence or structural robustness may override a specific aspect ratio goal. In any event, the anti-skew features reduce the constrainable width, preferably to 85% or less of the ink stick width in this region without such features. Also, the anti-skew features 408A-D in alternative embodiments need not necessarily be equally sized. Some size differences may be used to achieve specific desired ink stick masses, which may facilitate achieving uniformity across sets of differently colored ink sticks. For example, one indentation may be larger than the other one as a result of a greater volume of material being removed from the stick to form the indentation. In other embodiments, the widths of the two skew limiters sum to a distance that produces a waist that is preferably about ninety (90) percent or less than the length of the ink stick. A skew limiter may also only be present on only one side of an ink stick on account of asymmetrical features or other considerations.

Figure 10:
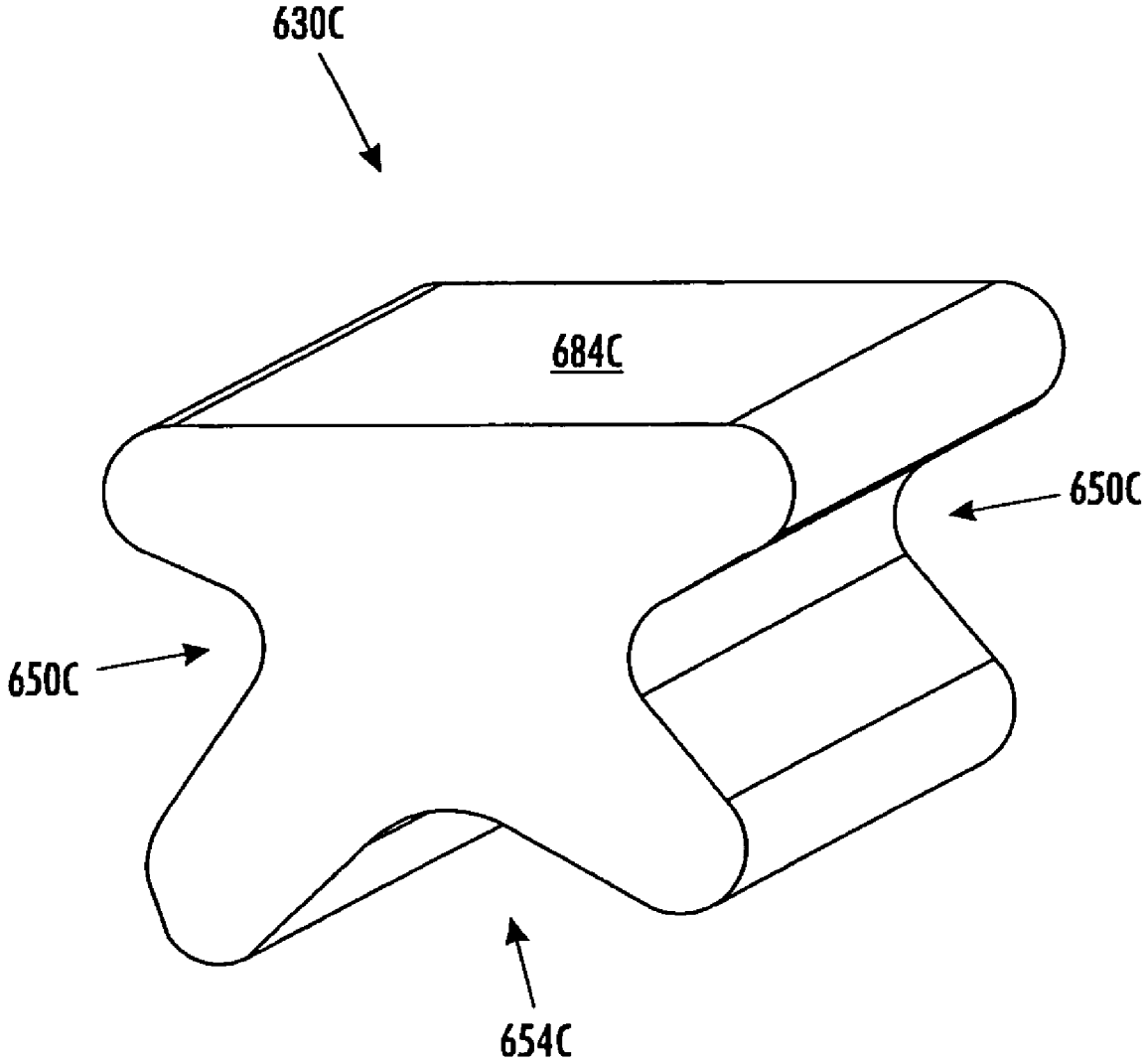
FIG. 10 is a top/front perspective view of another exemplary alternative ink stick.

FIG. 10 is a top/front perspective view of another exemplary alternative ink stick 630C, which may be used for configuring alternative embodiments of other ink stick colors. FIG. 10 focuses on the ink stick 630C for clarity of exposition. As at least partially discernable in FIG. 10, the alternative ink stick 630C defines stylized lateral anti-skew features 650C that operate similarly to the anti-skew features 408A-D (see, e.g., FIG. 11). Ink stick 630 also includes respective stylized bottom female features 654A-D that perform similarly to the support features 412A-D. Alternative embodiments may also define guide features in the respective top surfaces 684A-D. In other embodiments, the skew limiters and support features may even be configured to resemble the shape of the letter "X" or any other suitable symbolic and/or suggestive shape(s). Thus, the skew limiters may be curved or arcurate, and, in some cases, the curvature may be significant. As depicted in the configuration of FIG. 10, the supporting area of the interfacing rail 148C need not support weight in the same vector as the lower guide 141C to maintain the advantage over a lean support that is directly lateral, as done in the prior art.

In exemplary operation of phase change ink printer 110, phase change ink printer 110 uses four colors of ink (e.g., yellow, cyan, magenta, and black). First, a user opens the ink access cover 120. The keyed openings 124A-D aid the user in inserting (as generally indicated by the respective directional lines 131A-D) only respective ink sticks 330A-D of the proper colors into each respective feed channel 129A-D. After the user inserts ink sticks 330A-D through the keyed openings 124A-D, the user closes the ink access cover 120. Provided that the user has inserted the proper series or type of ink sticks 330A-D, push blocks 134A-D push the respective ink sticks 330A-D along their respective corresponding feed channels 129A-D (as generally indicated by respective directional lines 337A-D) towards the respective melt plates 132A-D.

Figure 11:
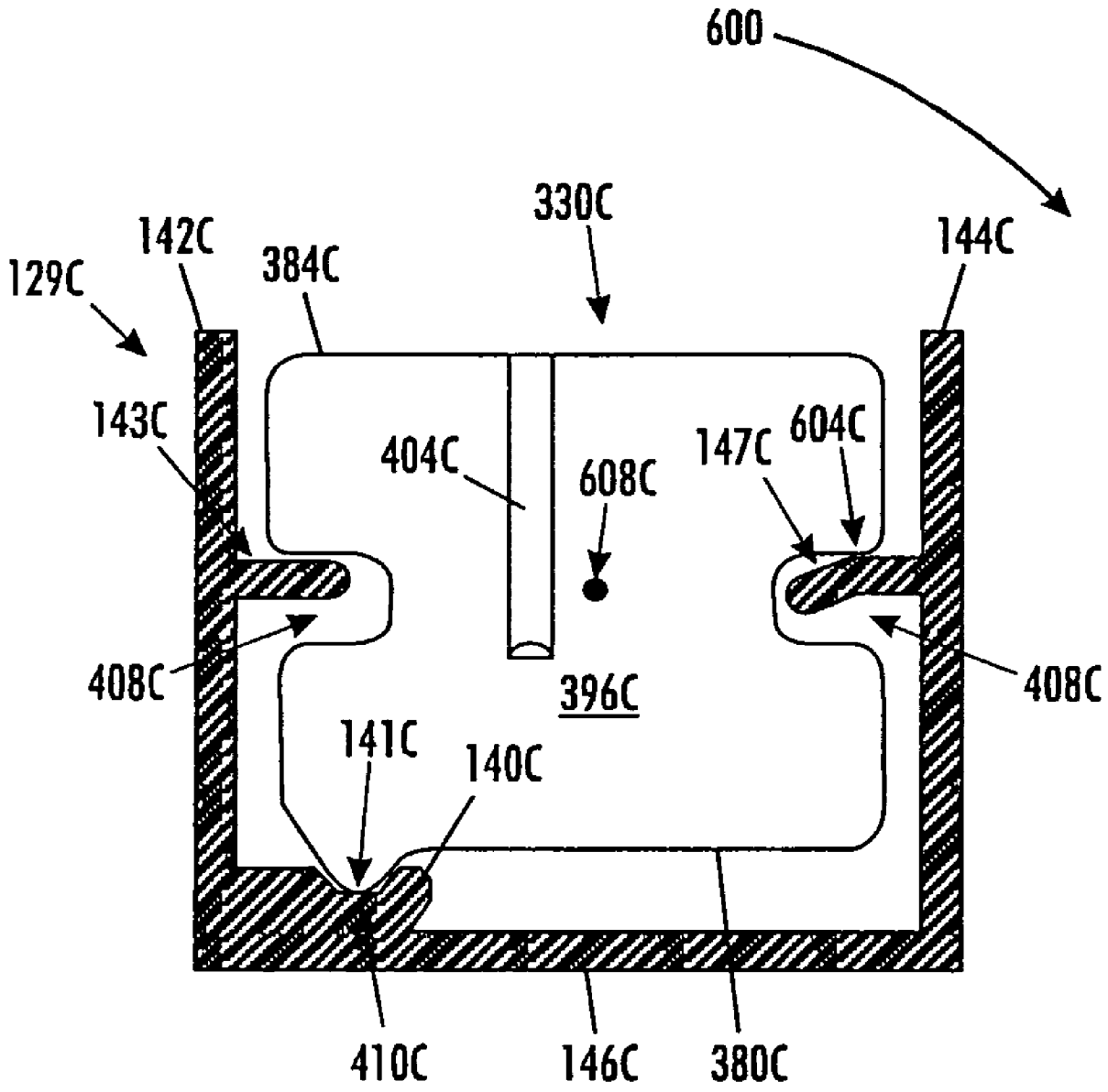
FIG. 11 is a simplified cross-sectional view of the feed channel of FIG. 5 taken along line 11-11 of FIG. 5 with one of the exemplary ink sticks of FIG. 8 therein.

FIG. 11 is a simplified cross-sectional view of the feed channel 129C taken along line 11-11 of FIG. 5 with one of the exemplary ink sticks 330C therein. FIG. 11 focuses on the feed channel 129C for clarity of exposition. As an ink stick 330C advances through the feed channel 129C, the ink stick 330C remains substantially upright but does pivot or tilt slightly as generally indicated by the arrow 600. During normal operations, the feed channel side support/guide rail 143C extends into the respective female feature 408C but does not contact the waist of ink stick 330C. The primary support and alignment for the ink stick 330C within the feed channel 129C are the engagement between the male feature 410C and the feed channel support/guide groove 141C and the engagement between the feed channel side support/guide rail 147C and the female feature 408C. Thus, the feed channel side support/guide rail 143C is a non-load bearing, while the feed channel side support/guide rail 147C bears the weight load 604C. Little or no lateral force or load occurs on the sides of the feed channel guide 141C when the upper surface of the ink stick female feature 408C is horizontal, relative to the view depicted in FIG. 11. This feature may be angled, however.

The minimal contact between an ink stick 330A-D and its respective feed channel 129A-D reduces opportunities for chips or flakes from the ink stick to interfere with the progress of the ink stick through the feed channel. Additionally, engagements between the supports 410A-D (of the respective ink sticks 330A-D) and the respective feed channel support/guide grooves 141A-D (of the respective feed channels 129A-D) and the engagements between the feed channel side support/guide rails 147A-D (of the respective feed channels 129A-D) and the respective skew limiters 408A-D (of the respective ink sticks 330A-D) work to reduce skewing within the channels. This action helps maintain proper orientation of the ink sticks 330A-D as the ink sticks 330A-D progress along the lengths of the respective feed channels 129A-D to the respective melt plates 132A-D.

With the ink sticks 330A-D properly aligned within the respective feed channels 129A-D, the ink sticks 330A-D meet the respective melt plates 132A-D generally normal to the melt plate surfaces, which promotes even melting of the ink sticks 330A-D against the melt plates 132A-D. Even melting reduces the formation of unmelted slivers, which might otherwise form at the trailing end of each ink stick 330A-D, and thus reduces the potential for such unmelted slivers to slip through the respective gaps 133A-D between the ends of the feed channels 129A-D and the melt plates 132A-D. Passage of unmelted slivers is uncontrolled and may cause color mixing or may impair the performance of certain portions of the phase change ink printer 110. Guiding the ink sticks 330A-D to maintain their alignments in the respective feed channels 129A-D also ameliorates and/or prevents jamming due to skewing of the ink sticks 330A-D as they move through the respective feed channels 129A-D.

Engagement between the support 410A-D of the respective ink sticks 330A-D and the respective feed channel support/guide grooves 141A-D of the respective feed channels 129A-D and engagement between the feed channel side support/guide rails 147A-D of the respective feed channels 129A-D and the respective skew limiters 408A-D also reduce "steering" effects that the push blocks 134A-D may have when acting on the respective back surfaces 396A-D of the ink sticks 330A-D. Thus, laterally offset pressure by the push blocks 134A-D on the respective ink sticks 330A-D is of lesser concern, and maintaining a more exact lateral feed friction balance with the force exerted by the push blocks 134A-D on the respective ink sticks 330A-D is less critical than with some other designs.

Additionally, the feed channel side support/guide rails 143A-D and the respective skew limiters 408A-D, in conjunction with the feed channel side support/guide rails 147A-D, respectively, work to inhibit reverse pivoting and/or other dislodging of the ink sticks 330A-D in the respective feed channels 129A-D. This inhibition occurs as the skew limiters 408A-D abut or stop against the feed channel side support/guide rails 143A-D and/or the feed channel side support/guide rails 147A-D when the phase change ink printer is handled, moved, transported, or otherwise jostled in a manner which might otherwise dislodge the ink sticks 330A-D.

Figure 12:
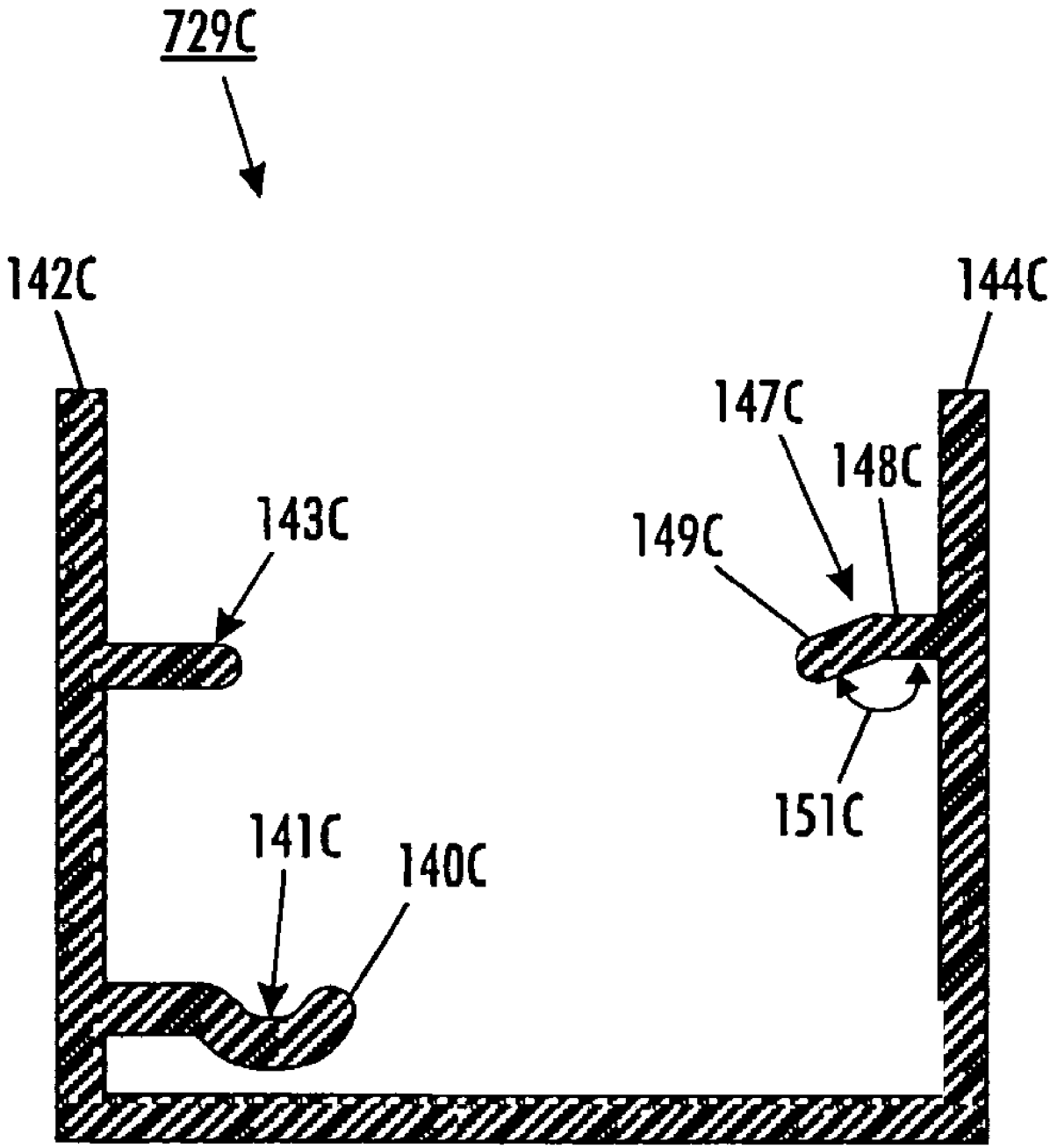
FIG. 12 is a simplified cross-sectional view of an alternative feed channel from the perspective of line 12-12 of FIG. 5.

Those skilled in the art will recognize that numerous modifications can be made to the specific implementations described above. In the exemplary embodiment, the portions 148A-D of the respective feed channel side support/guide rails 147A-D bend into the respective portions 149A-D such that the surface areas bearing the respective vertical loads 604A-D are quite small. In alternative embodiments, the feed channel side support/guide rails 147A-D and/or the ink sticks 330A-D may be constructed with depressions, discontinuities, or the like for intermittent contact with the respective vertical loads 604A-D along their respective lengths, and/or may include substantially flat or planar surfaces, notches and/or other complimentary features for bearing the respective vertical loads 604A-D. Further, FIG. 12 is a simplified cross-sectional view of an alternative feed channel 729C from the perspective of line 12-12 of FIG. 5. As at least partially discernable in FIG. 12, an alternative phase change ink printer is configured and operates in a like manner as the phase change ink printer 110 except that in lower portions of similarly configured alternative embodiments for feed channels 729A-D (FIG. 12 focuses on feed channel 729C for clarity of exposition) the longitudinal feed channel support/guide rails 140A-D and the accompanying longitudinal feed channel support/guide grooves 141A-D are separated from the floor of the feed channels 729A-D. In any event, those skilled in the art will recognize that the support/guide rail(s) of the feed channel(s) and the complementary features of the ink sticks may have numerous other suitable shapes other than the particular shapes illustrated. Additionally, the various male-female implementations of the various key and/or support/guide features may be suitably reversed or inverted. Furthermore, numerous other configurations of the feed channel, key plate, and other components of the ink feed system can be constructed. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An ink stick for use in a phase change ink printer comprising:

an ink stick body having a bottom surface, a top surface, a lateral dimension between two sides of the ink stick, and a lateral center of gravity within the lateral dimension;

a support elevationally offset from a bottom surface of the ink stick body, the support being located at a position that is laterally offset from the lateral center of gravity within the lateral dimension; and a skew limiter in a side of the ink stick body that is opposite the lateral offset position of the support, the skew limiter being located in the side of the ink stick body intermediate between the bottom surface and the top surface of the ink stick body and the skew limiter being positioned and sized to provide a length to core width ratio of at least 1.2:1.

2. The ink stick of claim 1, the skew limiter further comprising:

an indention in the side of the ink stick body for receiving a guide rail extending from a side wall of a feed channel in a phase change printer.

3. The ink stick of claim 2 wherein the indentation is generally U-shaped.

4. The ink stick of claim 2 wherein the indentation is generally V-shaped.

5. The ink stick of claim 1, the skew limiter further comprising;

a protuberance extending from the side of the ink stick for interacting with a guide in a side wall of a feed channel in a phase change printer.

6. The ink stick of claim 1, the skew limiter including:

a pair of indentations, one in each lateral side of the ink stick at a position proximate a vertical center of mass between the bottom surface and the top surface of the ink stick and configured to increase peripheral surface area.

7. The ink stick of claim 6, the indentations having a generally rectilinear shape and at least one of the indentations having at least one surface that is at least partially arcurate.

8. The ink stick of claim 6, one of the indentations being larger than the other indentation.

9. The ink stick of claim 1, the skew limiter including:

a pair of protuberances with one protuberance extending from each lateral side of the ink stick, each protuberance being located at a position intermediate the bottom surface and the top surface of the ink stick.

10. A solid ink stick loader for a phase change ink printer comprising:

an insertion key plate for excluding ink sticks without features conforming to a keyed opening in the insertion key plate;

a plurality of feed channels, each feed channel receiving ink sticks through a keyed opening in the insertion key plate and each feed channel including a bottom surface;

a plurality of push blocks, one push block in the plurality of push blocks being aligned with a feed channel to move ink sticks longitudinally through the feed channel;

a lower support mounted parallel to and laterally offset from a central longitudinal axis of the feed channel, and a portion of the lower support that supports a mass of an ink stick is vertically displaced from the bottom surface of the feed channel; and a protruding longitudinal feed channel rail located at an elevated position relative to the lower support at a lateral side wall of the feed channel.

11. The solid ink stick loader of claim 10, the longitudinal feed channel rail further comprising:

a contactor that extends from the lateral side wall of the feed channel towards the central longitudinal axis of the feed channel.

12. The solid ink stick loader of claim 11, the longitudinal feed channel rail further comprising:

an extension that extends from the contactor to enable limited contact with an ink stick to an area along the contactor portion.

13. The solid ink stick loader of claim 11 wherein the extension extends from the contactor at an angle less than 180 degrees relative to the contactor.

14. The solid ink loader of claim 12 further comprising:

a second longitudinal feed channel rail located at a position opposite the first longitudinal feed channel rail and on a lateral side wall of the feed channel that is opposite the central longitudinal axis of the feed channel from the lateral side wall from which the other longitudinal feed channel rail is located.

15. A method for delivering solid ink sticks to a melt plate through a feed channel comprising:

receiving ink sticks through keyed openings in an insertion plate;

pushing the ink sticks along a longitudinal axis of a feed channel;

supporting a bottom portion of the ink stick only at a position that is laterally offset from a lateral center of gravity for the ink sticks and vertically offset from a bottom of the ink sticks; and limiting skewing of the ink stick with a guide rail in the channel to reduce steering effects from pushing the ink sticks along the longitudinal axis of the feed channel.

16. The method of claim 15 further comprising:

pushing the ink stick through one or more feed key features before the ink stick contacts a melt plate.

17. The method of claim 15, the skew limiting further comprising:

limiting skewing of the ink stick at a position laterally opposite the bottom portion of the ink stick being supported.

18. The method of claim 17, the skew limiting further comprising:

limiting skewing of the ink stick at another lateral side of the ink stick.

19. The method of claim 15, the pushing of the ink sticks further comprising:

pushing the ink sticks with a driven push block.

20. The method of claim 15, the pushing of the ink sticks further comprising:

pushing the ink sticks with gravity.

* * * * *